US005806767A

United States Patent [19]

Polti et al.

[11] Patent Number: 5,806,767

[45] Date of Patent: Sep. 15, 1998

[54] CLEANING MACHINE, PARTICULARLY FOR DOMESTIC USE

[75] Inventors: Franco Polti, Olgiate Comasco; Mauro Pogliani, Villaguardia, both of Italy

[73] Assignee: Polti S.p.A., Como, Italy

[21] Appl. No.: 821,371

[22] Filed: Mar. 20, 1997

[30] Foreign Application Priority Data

Mar. 28, 1996 [EP] European Pat. Off. ..... 96830156

[51] Int. Cl.[6] ..... B05B 1/24; B05B 1/30

[52] U.S. Cl. ..... 239/135; 239/525; 239/578; 251/129.04

[58] Field of Search ..... 239/128, 135, 239/525, 569, 578; 251/57, 129.04

[56] References Cited

U.S. PATENT DOCUMENTS

| | | | |
|---|---|---|---|
| 1,726,721 | 9/1929 | Schullstrom | 251/129.04 X |
| 3,873,790 | 3/1975 | Coons et al. . | |
| 5,054,947 | 10/1991 | Frank et al. . | |
| 5,071,069 | 12/1991 | Stirm | 239/128 |
| 5,535,949 | 7/1996 | Boisture | 251/57 X |
| 5,628,490 | 5/1997 | Roberts et al. | 251/57 |

FOREIGN PATENT DOCUMENTS

| | | |
|---|---|---|
| 0 178335A1 | 10/1984 | European Pat. Off. . |
| 0 156011A1 | 12/1984 | European Pat. Off. . |
| 0 485827A1 | 11/1991 | European Pat. Off. . |
| 33 12434A1 | 4/1983 | Germany . |

*Primary Examiner*—Andres Kashnikow
*Assistant Examiner*—Robin O. Evans

[57] ABSTRACT

A cleaning machine, particularly for domestic use, that provides the greatest possible protection against the risk of electric shocks even if the discharge pipe comes into contact with or is immersed in water in the course of cleaning operations, comprising a line for the communication of fluid between the discharge pipe and the machine, also comprises electrical components and switches for their actuation housed inside a casing, manually actuated pressure-generating means located alongside the discharge pipe, actuator means sensitive to the variations in pressure and connected to said switches and means of pneumatic transmission connected between said pressure-generating means and said actuator means.

26 Claims, 2 Drawing Sheets

CLEANING MACHINE, PARTICULARLY FOR DOMESTIC USE

BACKGROUND OF THE INVENTION

1. Field of the Invention

The present invention relates to a cleaning machine, particularly for domestic use, of the type that comprises a casing, electrical components housed inside the casing, at least one switch for controlling said electrical components, a discharge pipe for cleaning operations, with at least one nozzle, and at least one fluid line for the communication of fluid between said at least one nozzle and the electrical component.

2. Description of the Prior Art

Machines are known for cleaning by means of steam, in particular, that house inside a casing a boiler and an electrically operated valve that controls the emission of steam from the boiler. The emitted steam is conveyed along a flexible fluid line to a nozzle, which in this case is a fluid discharge pipe.

These cleaning machines are usually fitted with a switch for controlling the electrically operated valve and this switch is located on the grip of the fluid discharge pipe. This allows the user of the machine to control the release of steam from the boiler by acting directly on the grip of the discharge pipe.

Although excellent from the practical point of view, the location of the switch does not give the user the necessary protection.

The problem is that the switch is connected up to an electrical circuit for the control of the electrically operated valve at a use voltage which is equal to that of the mains, generally 110 or 220 V and certainly greater than 100 V.

The user therefore risks electrocuting himself when operating the switch if, for example, both hands are not perfectly dry, a situation which is far from unlikely given that these machines are used for cleaning purposes and that such an activity frequently involves the use of water or other liquids.

A similar risk arises when the discharge pipe is operated in the presence of open containers full of water, such as tubs or baths. If the discharge pipe were to be accidentally dropped into the water, a short-circuit and an additional risk of electrocution would result.

The problem described above occurs, in the field of cleaning machines, not only when steam is used but also when other fluids are sprayed or nebulized in the liquid state, such as water, detergents and the like, using a discharge pipe on which it is desirable to mount its control means.

The problem also occurs in the same way with cleaning machines designed to suck in liquids and discharge them through the nozzle of the above mentioned discharge pipe.

It has been proposed that the discharge pipe should be fitted with a low-voltage control acting through a step-down transformer located inside the machine casing.

This solution has the drawback that, in order to ensure that the internal parts of the machine are kept waterproof, it is impossible to provide an efficient system of ventilation to cool the transformer, because the casing of the cleaning machine cannot have any ventilation apertures if it is to be leakproof, since it must be able to operate in environments in which it may be wetted accidentally.

Furthermore, both the ventilation and the transformer themselves represent a considerable extra cost as the high temperatures which can develop inside the casing of the machine during its operation make it necessary to employ a special type of insulated transformer which is expensive.

SUMMARY OF THE INVENTION

The technical problem which is the starting point of the present invention is that of devising a cleaning machine that overcomes the problems indicated above with reference to the prior art.

This problem is solved by a cleaning machine of the type specified, characterized in that it comprises manually actuated pressure-generating means located alongside the discharge pipe, actuator means sensitive to the variations in pressure and connected to said at least one switch, and means of pneumatic transmission connected between said pressure-generating means and said actuator means, said at least one switch being housed inside said casing.

The chief advantage of the cleaning machine according to the invention is that all the parts that use electrical energy are housed inside the casing of the cleaning machine, while the grip of the discharge pipe can be soaked with water without any danger of the user's being electrocuted.

According to another aspect of the invention, said actuator means are located out of the casing of the cleaning machine. The means of pneumatic transmission comprises a flexible line contained inside a flexible protection tube housing also the fluid line. At the end of the flexible tube the machine comprises removable plug-in means having a plug-in part, connected to the casing of the cleaning machine, and a complementary plug-in part connected to the protective tube.

Said actuator means are housed inside said complementary plug-in part and acts on said switch through an orifice formed in the casing.

This feature allows the pneumatic transmission circuit, the pressure pulse generating means and the actuator means to be protected inside the handle of the discharge pipe, the protection tube and the complementary plug-in part.

In particular the actuator means are protected form the heat sources located inside the housing, i.e. electric motors, steam generator or the like.

Other features and advantages of the present invention will appear from the description of a preferred embodiment in the form of a steam cleaning machine.

DESCRIPTION OF THE PREFERRED EMBODIMENT

Figure 1:
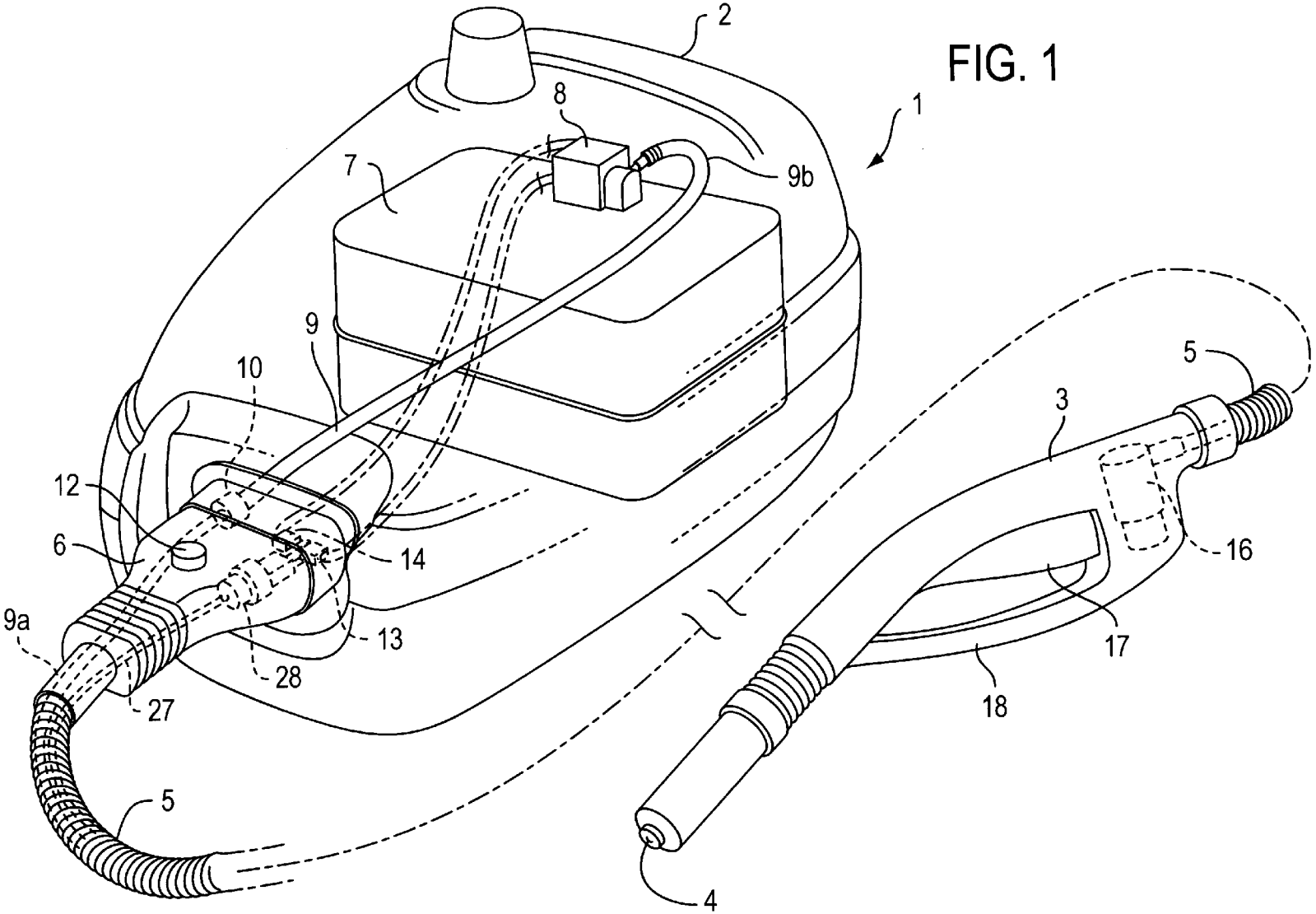
FIG. 1 is a perspective view in partial section in perspective of a steam cleaning machine according to the invention.
Figure 2:
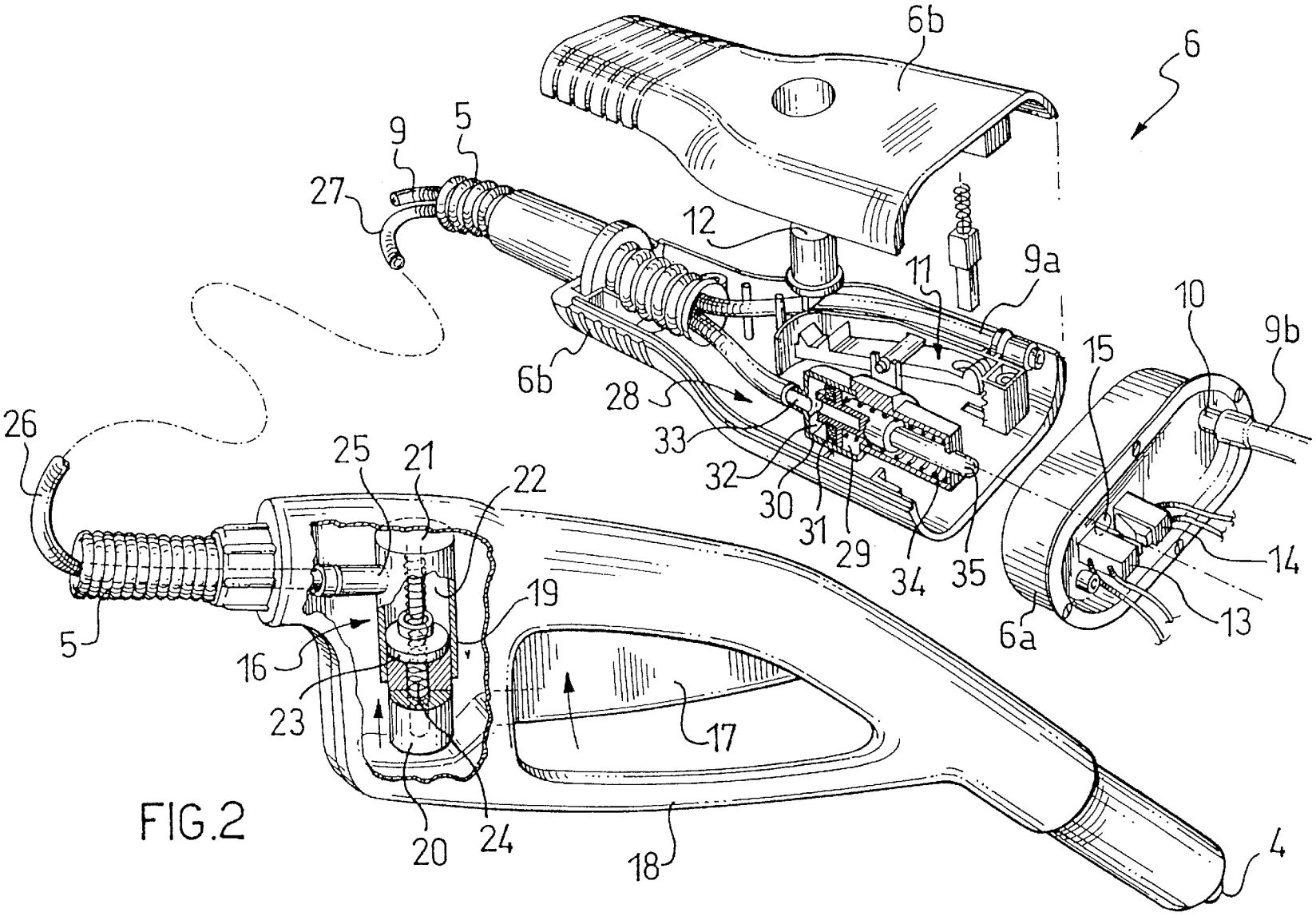
FIG. 2 is a perspective view of a detail of the machine shown in FIG. 1.

With reference to the FIG.1 is a general reference for a machine for domestic use for cleaning with blown steam.

The machine 1 comprises a casing 2 roughly in the form of a parallelepiped, and a fluid discharge pipe 3 for cleaning operations, for discharging steam, that has a nozzle 4 at one end.

The machine 1 also comprises a flexible protective tube 5 and removable plug-in means 6 connected to the casing 2. The protective tube runs between the discharge pipe 3 and the removable plug-in means 6.

The machine additionally comprises a steam-generating boiler 7 housed inside the casing 2, an electrically operated valve 8 connected to the boiler for the emission of steam, this being an electrical component of the machine 1, and a fluid line 9 for conveying steam, i.e. a steam line, made of a flexible material for the communication of fluid, i.e. steam, between the nozzle 4 and the electrically operated valve 8 to which the steam line 9 is connected.

A first portion 9i aof the steam line 9 is housed inside the protective tube 5 and runs between the plug-in means 6 and the nozzle 4, and a second portion 9*b* of the steam line 9 is housed inside the casing 2 and runs between the plug-in means 6 and the electrically operated valve 8.

The removable plug-in means 6 comprise a plug-in part 6*a* connected to the casing 2 of the cleaning machine 1, and a complementary plug-in part 6*b* connected to the protective tube 5.

The part 6*a* and the complementary part 6*b* comprise a leaktight coupling 10 that joins together the first and second portions 9*a*, 9*b* of the steam line 9 when the complementary part 6*b* is plugged into the part 6*a*.

The complementary part 6*b* is fitted with a catch 11 for engagement with the plug-in part 6*a* of known type controlled by a push button 12.

The machine 1 comprises a pair of switches marked 13 and 14, respectively, housed inside the casing 2 of the machine 1 for independent control of the electrically operated valve 8, to which they are electrically connected by means of conventional circuits.

The switches 13, 14 are positioned on the rear of the plug-in part 6*a* which at this location has an orifice 15 for the purpose of operating said switches 13, 14, the function of which will be made clear by the following description.

The machine 1 according to the invention comprises, alongside the discharge pipe 3, pressure-generating means 16 actuated by hand and having, for this purpose, a manual actuating member 17 consisting of a trigger lever protected by a trigger guard 18.

The discharge pipe 3 thus assumes the general shape of a fuel-dispensing nozzle, its dimensions being such that it can easily be held and the trigger lever 17 squeezed by the fingers of the hand.

The pressure-generating means 16 comprise a first cylinder-and-piston system 19 housed inside the discharge pipe 3, in contact with the trigger lever 17 by which it is supported.

The first cylinder-and-piston system 19 comprises, in its interior, a first piston 20, directly connected to the trigger lever 17 which will be used to move it, and a first cylinder 21, which define a compression chamber 22 inside the cylinder-and-piston system 19.

Said first system 19 also comprises a lip seal 23 associated with said first piston 20. The seal 23 provides fluid leaktightness for the compression chamber 22 when the first pressure cylinder system 19 is compressed by squeezing the trigger lever 17.

However, when the lever 17 is released, the lip seal 23, owing to its purely conventional shape, places the compression chamber 22 in fluid communication with the exterior.

With regard to this, the first system 19 comprises a spring 24 mounted between the piston 20 and the cylinder 21. This spring is compressed when the trigger lever 17 is squeezed and causes the system 19 to expand when the lever 17 is released.

The first cylinder 21 includes a first aperture 25 inside the chamber 22 for transmitting variations in the pressure inside the chamber 22.

As regards this, the machine 1 according to the invention comprises means of pneumatic transmission 26 connected to said pressure-generating means 16. The pneumatic transmission means 26 comprise a transmission line 27 made of a flexible material connected to the aperture 25 of the cylinder-and-piston system 19.

The transmission line 27 contains a fluid which, under the normal operating conditions of the cleaning machine 1, can be regarded as more or less incompressible. According to the present embodiment this fluid is air.

The transmission line 27 is housed inside the protective tube 5 and extends as far as the complementary part 6*b* of the plug-in means 6.

The machine 1 according to the invention additionally comprises actuator means 28 sensitive to said variations in pressure set up inside said pressure-generating means 16 and connected, as will be explained later, to the switches 13, 14 housed inside the casing 2.

These actuator means 28 are housed inside said complementary plug-in part 6*b*.

Said actuator means 28 comprise a second pressure cylinder system 29 having a second cylinder 30 that houses a second piston 31 fitted with conventional seals. Said cylinder 30 and piston 31 define an expansion chamber 32 inside the second cylinder-and-piston system 29. The cylinder 30 comprises a second aperture 33 leading out of this expansion chamber 32 and connected to the transmission line 27.

Consequently said means of pneumatic transmission 26 are connected up, according to the invention, between the pressure-generating means 16 and the actuator means 28 sensitive to pressure variations.

The second cylinder-and-piston system 29 also comprises a spring 34 that opposes the movement of the second piston 31 when it detects an increase in pressure in the expansion chamber 32, and a control rod 35, attached to the piston 31, that extends out of the second cylinder-and-piston system 29 so as to project out of the complementary plug-in part 6*b*.

When the expansion chamber 32 is subjected to an increase in pressure and the second piston 31 is in the end-of-travel position with the spring 34 compressed, the control rod 35 passes into the casing 2 of the machine 1 by extending from the complementary plug-in part 6*b*, through said orifice 15, and into the plug-in part 6*a*.

It thus interacts with the switches 13, 14 that control the electrically operated valve 8.

With reference to the figures, the operation of the steam cleaning machine 1 is described below with reference to an initial condition in which the machine 1 is on, with the boiler 7 containing steam at pressure and with the electrically operated valve 8 closed.

The hand holding the discharge pipe 3 squeezes the trigger lever 17, causing the first piston 20 of the first cylinder-and-piston system 24 to be pushed against the action of the spring 24.

A pressure variation is generated inside the compression chamber 22. This variation is transmitted along the transmission line 27 to the second cylinder-and-piston system 29.

The second piston 31 is consequently moved against the action of the spring 34. In this way, as described earlier, the control rod 35 interacts, through the orifice 15 in the plug-in part 6*a*, with the switches 13, 14, closing the respective electrical circuits which control the opening of the electrically operated valve 8.

The result is an emission of steam from the nozzle 4 for the cleaning operations as long as the user continues to manually squeeze the trigger lever 17.

When the lever 17 is released, the springs 24, 34 return to their initial position and the control rod 35 draws back out of the orifice 15, interrupting the circuits of the switches 13, 14. This immediately closes the electrically operated valve 8 and interrupts the emission of steam from the nozzle 4.

The compression chamber 22 is not subjected, at this point, to a sudden depressurization in its interior which would prevent the elastic return of the spring 24 because the lip seal 23, urged open by the first piston 20, places the compression chamber 22 in fluid communication with the exterior when the first cylinder-and-piston system 19 is not compressed.

The inventive concept contained in the preferred example described above and relating to a steam cleaning machine is easily applicable to a different cleaning machine, such as for example a sprayer, nebulizer or vacuum cleaner, where, instead of the electrically operated valve, the machine comprises other electrical components such as pumps, fans, compressors and the like.

The actuator means which are sensitive to variations in pressure could comprise, instead of a cylinder-and-piston system, a pressure-detecting membrane or diaphragm. These means could be contained, together with the switches, inside the casing of the machine instead of in the complementary plug-in part.

Likewise the pressure-generating means could be a bellows design rather than a cylinder-and-piston system.

In addition to having the abovementioned advantage, the cleaning machine according to the invention is easy to use, and the possibility of separating the plug-in means by means of the catch 11 makes positioning and storing the machine simple.

Moreover, when the complementary part **6*b*** is detached from the machine casing, the discharge of steam is cut off immediately, which also occurs when the trigger lever is released, even accidentally.

The presence of the trigger guard also prevents accidental actuation of the trigger lever.

The discharge pipe 3 is easy to handle because of the flexible lines and protective tube.

If an accidental pressure variation occurs inside the transmission line 27 that controls the discharge of steam, for example because the protective tube is twisted or trodden on, this does not cause steam to be discharged because at the same time the lip seal is not keeping the first cylinder-and-piston system leaktight and the pressure-transmission circuit is open to the external environment.

The same also applies to the heating induced by the close proximity of the lines carrying air and boiling steam respectively. Indeed, the heating of the air of the pressure variation transmission means increases the speed of response of the machine because it makes this air even more incompressible.

In order to satisfy special particular needs, the machine described above can be modified or adapted, or parts can be replaced with other functionally equivalent parts, by a person skilled in the art, without thereby departing from the scope of protection of the invention as defined in the following claims.

We claim:

1. Cleaning machine, of the type that comprises a casing, electrical components housed inside the casing, at least one switch for controlling said electrical components, a discharge pipe for cleaning operations, with at least one nozzle, at least one fluid line for the communication of fluid between said at least one nozzle and the electrical components, manually actuated pressure-generating means located alongside the discharge pipe, actuator means sensitive to the variations in pressure and connected to said at least one switch, and means of pneumatic transmission connected between said pressure-generating means and said actuator means, said at least one switch being housed inside said casing.

2. Cleaning machine according to claim 1, wherein said pneumatic transmission means comprise a transmission line containing a fluid that is substantially incompressible under the conditions of operation.

3. Cleaning machine according to claim 2, wherein both said lines are made of a flexible material.

4. Cleaning machine according to claim 3, that comprises a protective flexible tube containing both said lines.

5. Cleaning machine according to claim 4, that comprises removable plug-in means connected to the casing, said protective tube running between the discharge pipe and the removable plug-in means.

6. Cleaning machine according to claim 5, wherein the removable plug-in means comprise a plug-in part connected to the casing, and a complementary plug-in part connected to the protective tube, said actuator means being housed inside the complementary plug-in part.

7. Cleaning machine according to claim 6, wherein the actuator means which are sensitive to the variations in pressure comprise a second cylinder-and-piston system having an expansion chamber in fluid communication with said transmission line.

8. Cleaning machine according to claim 7, wherein the second cylinder-and-piston system comprises a second piston connected to a control rod for interacting with said at least one switch.

9. Cleaning machine according to claim 8, wherein said control rod extends from said complementary plug-in part through an orifice in said plug-in part.

10. Cleaning machine according to claim 9, wherein said pressure-generating means comprise a manual actuating member connected to a first cylinder-and-piston system having a compression chamber in fluid communication with said transmission line.

11. Cleaning machine according to claim 10, wherein the first cylinder-and-piston system comprises a first piston and a lip seal associated with the first piston providing fluid leaktightness when the first pressure cylinder system is compressed and placing the compression chamber in fluid communication with the exterior when the first cylinder-and-piston system is not compressed.

12. Cleaning machine according to claim 10, wherein said manual actuating member is a trigger lever.

13. Cleaning machine according to claim 12, wherein the trigger lever is protected by a trigger guard.

14. Machine for cleaning with blown steam of the type that comprises a casing, a boiler housed inside the casing for generating steam, at least one electrically operated valve, connected to the boiler and connected to a steam line, for the emission of steam, at least one switch for controlling said at least one electrically operated valve, a steam discharge pipe for cleaning operations, with at least one nozzle, said steam putting in communication said at least one nozzle and said at least one electrically operated valve, manually actuated pressure-generating means located alongside the steam discharge pipe, actuator means sensitive to the variations in pressure and connected to said at least one switch, and means of pneumatic transmission connected between said pressure-generating means and said actuator means, said at least one switch being housed inside said casing.

15. Machine for cleaning with blown steam according to claim 14, wherein said pneumatic transmission means comprise a transmission line containing a fluid that is substantially incompressible under the conditions of operation.

16. Machine for cleaning with blown steam according to claim 15, wherein both said lines are made of a flexible material.

17. Machine for cleaning with blown steam according to claim 16, that comprises a protective flexible tube containing both said lines.

18. Machine for cleaning with blown steam according to claim 17, that comprises removable plug-in means connected to the casing, said protective tube running between the steam discharge pipe and the removable plug-in means.

19. Machine for cleaning with blown steam according to claim 18, wherein the removable plug-in means comprise a plug-in part connected to the casing, and a complementary plug-in part connected to the protective tube, said actuator means being housed inside the complementary plug-in part.

20. Machine for cleaning with blown steam according to claim 19, wherein the actuator means which are sensitive to the variations in pressure comprise a second cylinder-and-piston system having an expansion chamber in fluid communication with said transmission line.

21. Machine for cleaning with blown steam according to claim 20, wherein the second cylinder-and-piston system comprises a second piston connected to a control rod for interacting with said at least one switch.

22. Machine for cleaning with blown steam according to claim 21, wherein said control rod extends from said complementary plug-in part through an orifice in said plug-in part.

23. Machine for cleaning with blown steam according to claim 22, wherein said pressure-generating means comprise a manual actuating member connected to a first cylinder-and-piston system having a compression chamber in fluid communication with said transmission line.

24. Machine for cleaning with blown steam according to claim 23, wherein the first cylinder-and-piston system comprises a first piston and a lip seal associated with the first piston providing fluid leaktightness when the first pressure cylinder system is compressed and placing the compression chamber in fluid communication with the exterior when the first cylinder-and-piston system is not compressed.

25. Machine for cleaning with blown steam according to claim 24, wherein said manual actuating member is a trigger lever.

26. Machine for cleaning with blown steam according to claim 25, wherein the trigger lever is protected by a trigger guard.

* * * * *